US009268306B2

(12) United States Patent
Briswalter et al.

(10) Patent No.: US 9,268,306 B2
(45) Date of Patent: Feb. 23, 2016

(54) MODULAR ASSEMBLY OF A PUSHER

(71) Applicant: MECO S.A., Grenchen (CH)

(72) Inventors: Sebastien Briswalter, Pfetterhouse (FR); Simon Waeckerlin, Grenchen (CH); Rico Walter, Bienne (CH)

(73) Assignee: Meco S.A., Grenchen (CH)

( * ) Notice: Subject to any disclaimer, the term of this patent is extended or adjusted under 35 U.S.C. 154(b) by 0 days.

(21) Appl. No.: 14/108,705

(22) Filed: Dec. 17, 2013

(65) Prior Publication Data

US 2014/0177404 A1 Jun. 26, 2014

(30) Foreign Application Priority Data

Dec. 21, 2012 (EP) ..... 12198852

(51) Int. Cl.
*G04B 3/04* (2006.01)
*G04B 37/10* (2006.01)

(52) U.S. Cl.
CPC ..... *G04B 3/048* (2013.01); *G04B 37/106* (2013.01); *Y10T 29/49586* (2015.01)

(58) Field of Classification Search
CPC ..... G04B 37/10; G04B 3/04; G04B 37/106; G04B 37/103; G04B 3/048; G05G 1/02; Y10T 29/49586
USPC ..... 368/206, 288–290, 306–308, 318–321
See application file for complete search history.

(56) References Cited

U.S. PATENT DOCUMENTS 4,089,158 A * 5/1978 Wenger ..... 368/216
4,178,751 A * 12/1979 Liautaud ..... A44C 5/0053 224/175
4,292,682 A * 9/1981 Wenger ..... 368/289
4,364,674 A * 12/1982 Tesch ..... G04B 37/106 368/308
4,529,323 A * 7/1985 Gagnebin ..... 368/291
5,383,166 A * 1/1995 Gallay ..... 368/288
5,663,934 A 9/1997 Wenger et al.
6,000,842 A * 12/1999 Muller ..... G04C 3/001 368/319
7,404,669 B2 * 7/2008 Lambert ..... G04B 27/002 368/319
2005/0254353 A1 * 11/2005 Cogoli ..... G04G 21/00 368/281
2008/0049562 A1 * 2/2008 Andren ..... G04G 21/00 368/295
2009/0251999 A1 * 10/2009 Tschumi et al. ..... 368/320
2013/0100782 A1 * 4/2013 Cattaneo et al. ..... 368/308

FOREIGN PATENT DOCUMENTS

CH 615 285 1/1980
CH 692 255 A5 4/2002
DE 43 18 758 C1 8/1994

(Continued)

OTHER PUBLICATIONS

European Search Report issued Jul. 23, 2013 in EP Application 12198852, filed on Dec. 21, 2012 (with English Translation).

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

Method for the modular assembly of a pusher to a watch case (100) including a preliminary step of assembling a sealed functional module (10), including a tube (7), a stem (8), at least one sealing gasket (5) and a return spring (3) arranged between a first fixed stop member and a second moveable stop member, and then a first step (E1) of assembling the sealed functional module (10) to the case (100), and finally a second step (E2) of assembling a pusher head (1) to the sealed functional module (10).

10 Claims, 3 Drawing Sheets

(56) References Cited

FOREIGN PATENT DOCUMENTS

| | | | |
|---|---|---|---|
| EP | 1 457 845 | A1 | 9/2004 |
| FR | 970 374 | | 1/1951 |
| FR | 2 049 317 | | 3/1971 |
| FR | 2 724 239 | A1 | 3/1996 |
| WO | WO 2007/113723 | A2 | 10/2007 |

* cited by examiner

MODULAR ASSEMBLY OF A PUSHER

This application claims priority from European Patent Application No. 12198852.1 filed 21.12.2012, the entire disclosure of which is incorporated herein by reference.

FIELD OF THE INVENTION

The present invention concerns an assembly method for a pusher, and a pusher suitable for implementing this method.

BACKGROUND OF THE INVENTION

To mount pushers on the middle part of a watch, it is known to fix a pusher body in a housing, generally provided on the edge of the case, and then to assemble the other constituent elements of the pusher once the pusher body has been driven or screwed into the middle part of the watch.

Given that each component of the pusher has to be assembled individually on the middle part outside of a specialised pusher workshop, the assembly is first of all relatively tedious, since it is not performed by specialists in this type of component, and relatively time-consuming. Secondly, since none of the functional parts are pre-assembled, it is impossible to test the completely assembled pusher before it is actually mounted on the middle part of the watch. Thus, with this assembly solution, it is not possible to check the sealing properties and travel setting of the pusher in a satisfactory manner prior to integration in the case.

To simplify assembly, for screw-in pushers, there exist tubes pre-fitted with sealing gaskets so that the sealing part is pre-assembled. In this case, the tube is screwed into the middle part in a first step, and then the stem is screwed in from the inside in a second step after the return spring of the pusher has been positioned and the pusher head has been pushed to the end-of-travel position. However, the drawback of this solution is that the sealing gaskets are liable to be damaged when the pusher stem is mounted, especially when this operation is not performed by a pusher specialist, and this solution does not allow the sealing and operating travel of the pusher to be pre-tested.

In order to overcome the drawbacks associated with the provision of individual components for pushers prior to the assembly thereof on the middle part of a watch, CH Patent No 692255 proposes a modular assembly solution, wherein a pusher is entirely assembled prior to mounting on the middle part, and then screwed in from the inside in a watch case using a tool acting on the pusher body. The drawback of this solution, however, is that it only applies to screw-in pushers, which must have a cylindrical head, particularly when there is no degree of freedom in rotation between the pusher body and the head.

There is consequently a need for an assembly method which is free of these known limitations.

SUMMARY OF THE INVENTION

In particular, it is an object of the present invention to propose a new assembly method for a pusher, which allows quick mounting onto the middle part with a limited number of assembly steps.

It is another object of the present invention to propose an alternative method for the modular assembly of a pusher which enables the operational features of the pusher to be tested independently prior to mounting on the middle part.

These objects are achieved by a method for the modular assembly of a pusher to a watch case according to the invention, characterized in that the method includes a preliminary step of assembling a sealed functional module, the sealed functional module including a tube, a stem, at least one sealing gasket and a return spring arranged between a first fixed stop member and a second moveable stop member, and then a first step of assembling the sealed functional module to the case, and finally a second step of assembling a pusher head to the sealed functional module.

These objects are also achieved via a modular pusher suitable for implementing the modular assembly method of the invention, including a tube, a stem, at least one sealing gasket, a return spring arranged between a first fixed stop member and a second moveable stop member, and a pusher head, characterized in that the pusher includes a sealed functional module including the tube, the stem, at least one sealing gasket, and the return spring, and also a means of assembling the sealed functional module to the pusher head and a means of assembling the sealed functional module to the case.

One advantage of the assembly method proposed by the present invention is that the method can be employed for a large number of pusher heads and for pushers having different travels.

Another advantage of the assembly method of the present invention is that it provides a uniform, sealed, functional system for pushers, regardless of the shape of the pusher head and tube.

Further advantages of the proposed solution concern after-sales service, since it is now possible to change the head of a pre-assembled body, which, for example, means that an operation to repair the head alone can be performed without requiring the replacement of the entire pusher. Similarly, it is also possible to dismantle the head to access a sealing component requiring replacement during after sales-service without having to replace the entire pusher.

BRIEF DESCRIPTION OF THE DRAWINGS

Other features and advantages of the invention will become clear from the following detailed description, and drawings, in which.

DETAILED DESCRIPTION OF THE INVENTION

Figure 1:
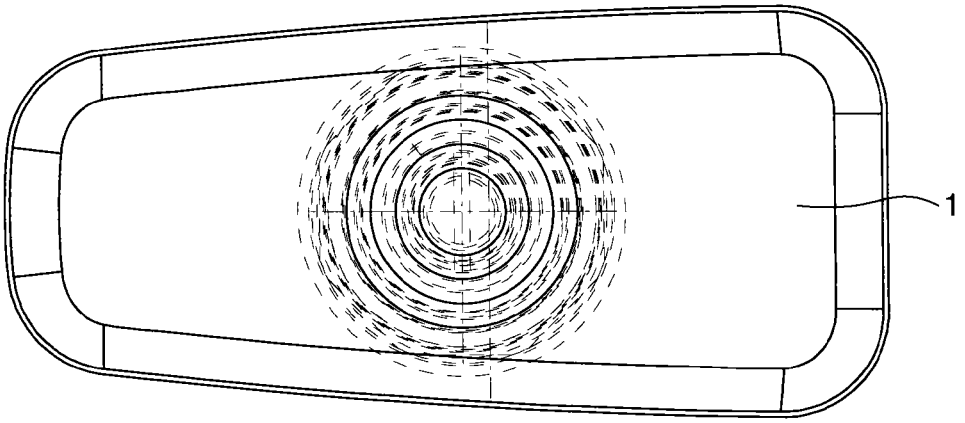
FIG. 1 is a top view of a pusher according to a first preferred embodiment for implementing the present invention.

FIG. 1 shows a top view of a pusher head 1 of almost parallelepiped shape. The quadrilateral illustrated is a rectangle slightly tapered to the left, i.e. whose left side is slightly smaller than the right side and thus the two large sides are not entirely parallel. This particular non-cylindrical head shape is used in the implementation of a first preferred embodiment of the invention.

Figure 2:
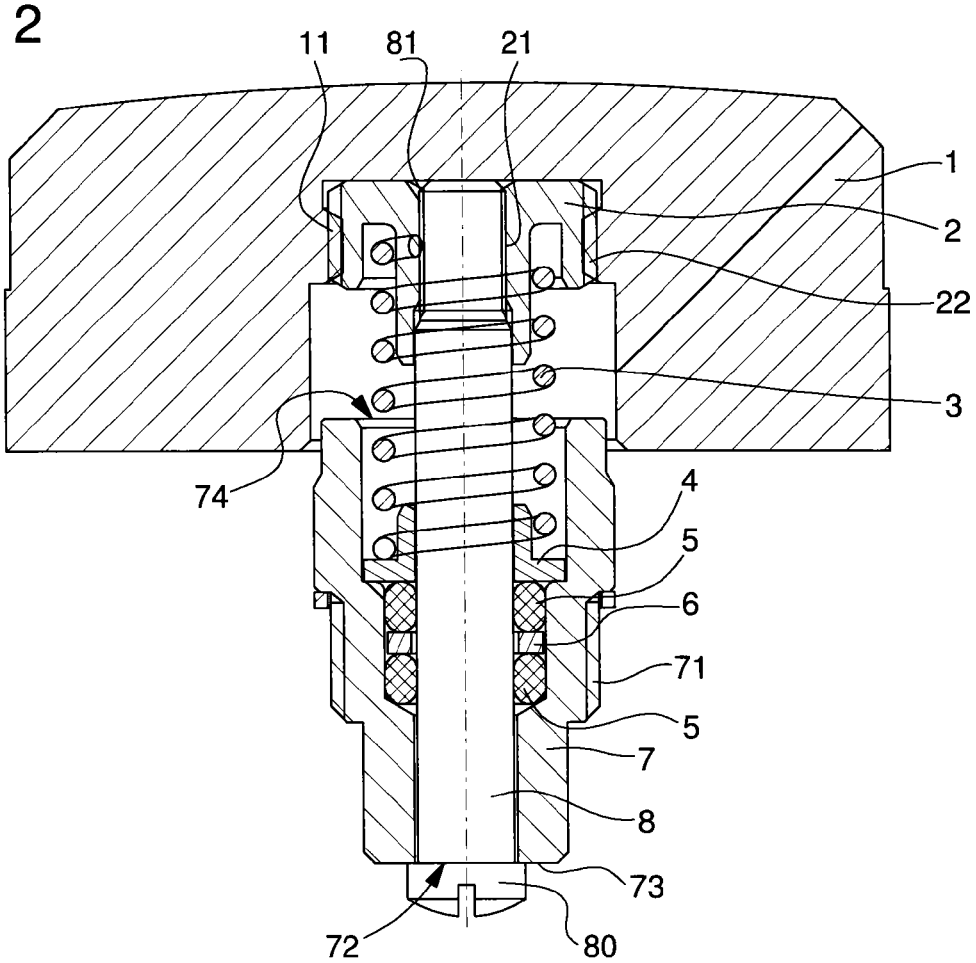
FIG. 2 is an sagittal cross-section of the pusher of FIG. 1.

FIG. 2 shows a sagittal cross-section of FIG. 1, which shows pusher head 1 assembled to a pusher body intended to be mounted in a watch case or middle part. Although the preferred embodiments of the invention below only involve screw-in pushers, i.e. wherein the pusher body is screwed into the case in which the pushers are intended to be mounted, it will, however, be clear that the invention also applies to pushers which are driven in or secured to the case in any other manner.

The pusher body of FIG. 2 consists of a tube 7 on which there is arranged a screw thread 71 for assembly to a case 100, referenced below in FIGS. 3 and 4. In this case, watch case 100 has a complementary assembling means in the form of a tapped hole 102, also shown in these Figures. A stem 8 is mounted in tube 7. At the lower end of the stem there is a head forming a first rotational drive means 80 for stem 8 and into which a tool can be inserted for this purpose. The head of the stem, whose shape is the same as a screw head, is slightly wider than the lower orifice 72 of the tube, so that stem 8 is necessarily engaged in tube 7 via this end until the head abuts against the bottom wall 73 of tube 7. The position illustrated in FIG. 2 is the pusher rest position, where return spring 3, inserted into the upper orifice of tube 7, tends to extend between a first fixed stop member formed by a first ring 4 mounted above O-ring type sealing gaskets 5, and a second moveable stop member formed by insert 2 mounted on the top end of stem 8. According to this preferred embodiment, insert 2 includes an internal thread 21 which is engaged on a first threaded end 81 of stem 8 at the top end thereof. Insert 2 also includes a screw thread on the external part thereof, which is intended to cooperated with a threaded hole 11 of pusher head 1 for the assembly thereof. Other assembly modes may also be envisaged, such as for example driving the insert onto the end of the stem; however, the advantage of the screw-in assembly shown in this Figure is that it is reversible, and thus enables pusher head 1 to be replaced in a modular manner.

According to the preferred embodiment of the invention illustrated in FIG. 2, the sealing of the pusher is optimised by the use of 2 superposed sealing gaskets 5, separated by an intermediate ring 6 so that they cannot roll onto each other.

Figure 3:
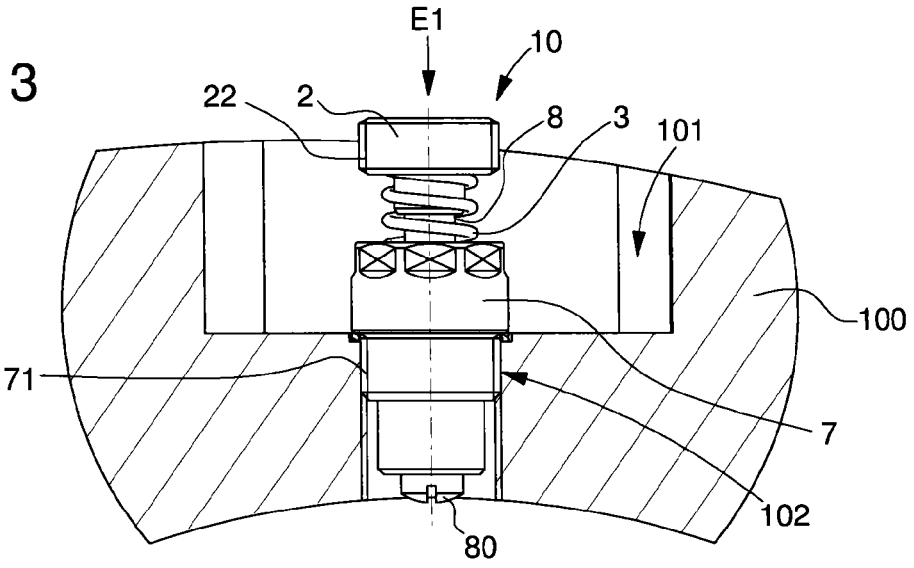
FIG. 3 is a second sagittal cross-section of the pusher of FIG. 2, once the first pusher module has been mounted in the middle part.
Figure 4:
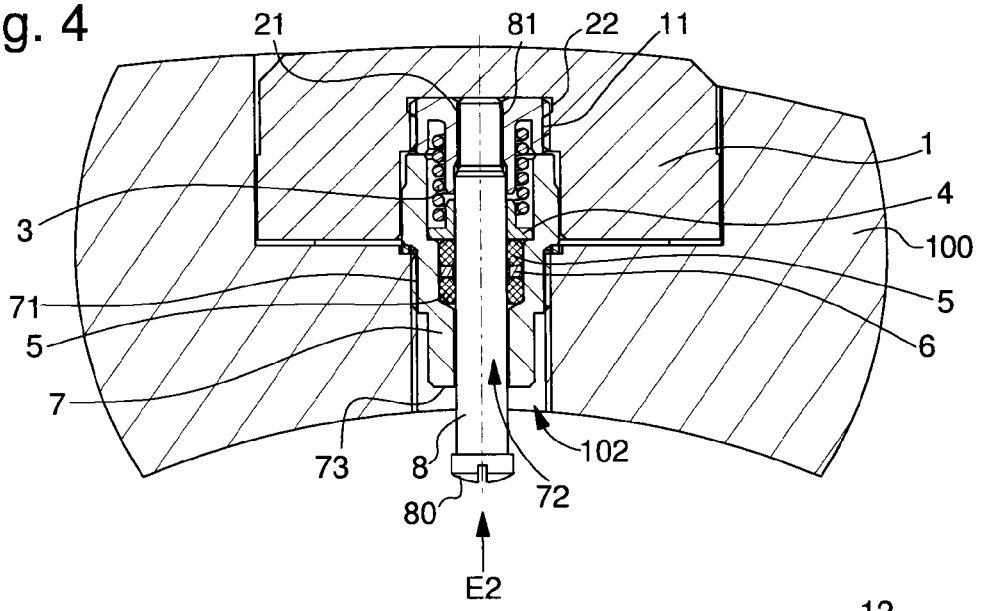
FIG. 4 is third sagittal cross-section of the pusher of FIG. 3 during the final mounting of the pusher head.

FIGS. 3 to 4 illustrate different assembly steps for the pusher of FIG. 2 according to the invention. Once stem 8 of the pusher has been inserted into tube 7 through lower orifice 72, and following the pre-positioning of sealing gaskets 5, intermediate ring 6 and first ring 4 which covers the same, return spring 3 can be positioned between said first ring 4 and insert 2 (screwed to the top end of the stem), which respectively form a first fixed stop member and a second moveable stop member for return spring 3. All of these elements form a sealed functional module 10. This sealed functional module 10 has the advantage of being uniform regardless of the shape of the pusher head. FIG. 3 shows functional module 10 assembled to case 100, after a first assembly step E1 performed from outside the case, here by screwing the screw thread 71 of tube 7 into the tapped hole 102 of case 100. To simplify this assembly step, tube 7 could have a special drive means, as for example illustrated in the second preferred embodiment described with reference to FIGS. 5 and 6 A-D, so that a tool can be used to carry out the screwing-in operation.

Once the first step E1 of assembling functional module 10 to case 100 has been carried out, pusher head 1 then has to be added to sealed functional module 10 to finish the assembly of the pusher. When the head does not have a cylindrical shape and housing 101, seen in FIG. 3, has a complementary shape, it is impossible to rotate pusher head 1 inside its housing 101. To overcome this drawback, the modular assembly method of the invention proposes to screw pusher head 1 onto an element integral with the stem—insert 2 here—, which here has a screw thread on the external part thereof, by driving the actual stem 8 in rotation. Insert 2 is then screwed into tapped hole 11 of pusher head 1, without directly acting on pusher head 1 in rotation, but only axially by bringing the head into abutment on the bottom of its housing 101 in case 100. As seen in FIG. 4, which shows a cross-section of the same elements as those illustrated in FIG. 2, with the addition of case 100 and its tapped hole 102 for screwing in tube 7, the second step E2 of assembling pusher head 1 to the pre-assembled sealed functional module 10 is performed from the inside of case 100, by the action of a tool (not shown) which drives stem 8 in rotation by acting of a first female rotational drive means 80, formed here by the head of stem 8. The head of the stem is released axially from the bottom wall of tube 73 when pusher head 1 is pushed to the bottom of its housing 101, which allows the tool to be engaged more easily and at the same time prevents any rotation of pusher head 1. To prevent insert 2 from being unscrewed from the first threaded end 81 of stem 8 during the pusher head assembly operation, screw threads having the same direction could be chosen for the internal thread of insert 21 and the external thread of insert 22, so that screwing pusher head 1 onto insert 22 tends simultaneously to screw in the insert of first threaded end 81 of stem 8 until the bottom of tapped hole 11 of pusher head 1 abuts insert 2.

Although this second step of assembling pusher head 1 to sealed functional module 10 does not enable the length of the pusher travel to be adjusted, it should however be noted that the travel may be pre-adjusted, for a given shape of crown head 1, by acting directly, for example, on the height of insert 2 and the axial positioning of first threaded end 81 of stem 8. In other words, the pusher travel can be adjusted by acting directly on the pre-assembled sealed functional module 10.

Figure 5:
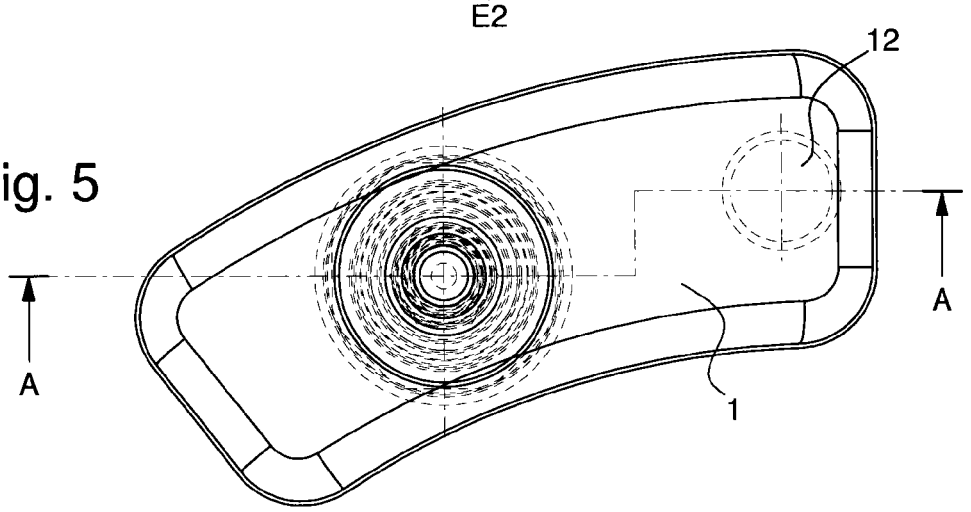
FIG. 5 is a top view of a pusher according to a second preferred embodiment for implementing the present invention.

FIG. 5 shows a pusher having a different, non-cylindrical shape which could be used for the modular assembly method of the invention. Pusher head 1 has a bowed shape here and is provided with a bore 12 intended to cooperate with a stud or pin (not shown) in the case or middle part. The cooperation of this bore 12 with a stud of the case is not only advantageous for the correct angular positioning of the pusher in its housing and guiding the travel of pusher head 1 when the latter is pushed in, but is also advantageous for embodiments wherein pusher head 1 is not intended to be arranged in a very deep housing, and projects relatively far outside the middle part. In that case, the cooperation of the stud with the bore in the head also enables pusher head 1 to be locked in rotation when the pusher is pushed in, preferably until it abuts the middle part, during the second assembly step E2 of sealed functional module 10 described above.

Figure 6A:
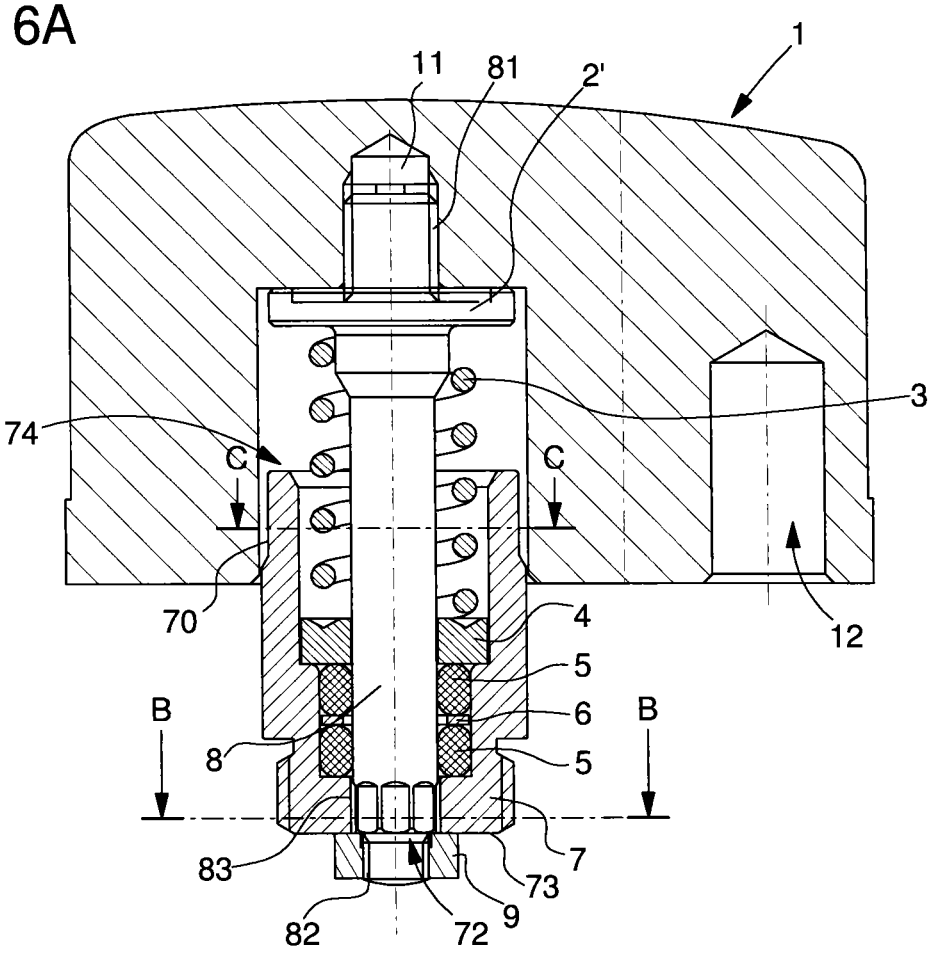
FIG. 6A is a first sagittal cross-section of the pusher of FIG. 5, along the axis A-A of FIG. 5.

FIG. 6A shows a similar sagittal cross-section to the view of FIG. 2 for the embodiment, along the cross-section A-A shown in FIG. 5

In this Figure, most of the pusher components are identical to those illustrated in FIG. 2. A major difference between this embodiment and that illustrated in FIG. 2 lies, however, in the fact that stem 8 is no longer provided with a head integral with its lower portion, but with a second screw thread. The second threaded stem end 82 is assembled to a nut 9, which is mounted in abutment on the bottom face of tube 73 to finalise the assembly of stem 8 in tube 7, after the pre-positioning of the two sealing gaskets 5, intermediate ring 6 between the two gaskets, the first ring 4 forming a first fixed stop member for return spring 3, and the return spring. According to an alternative embodiment (not shown), a retaining circlip could be disposed in a groove arranged in the bottom end of stem 8, in place of nut 9 and threaded stem end 82. One advantage of this solution is that it makes it easier to disassemble stem 8 during after-sales service, but a drawback is that, unlike nut 9, the circlip cannot be used as a means of driving stem 8 in rotation. Stem 8 also includes a collar 2' which, according to an alternative embodiment could however consist of a removable part distinct from the stem, and whose function is similar to that of insert 2, namely to provide a moveable stop member for return spring 3, and a stop member for mounting pusher head 1. It will therefore be clear that, unlike the embodiment of FIG. 2, stem 8 is not inserted here through the lower orifice 72 of tube 7, but through the upper orifice 74 and it is then fixed via nut 9 onto the lower face 74 of tube 7. At the top of tube 7, a means of driving in rotation 70 is arranged in the form of a portion of octagonal section, shown in detail in FIG. 6C which is a cross-section along the axis C-C of FIG. 3 showing tube 7, stem 8 and a cross-section of return spring 3. This drive means facilitates the assembly of the sealed functional module (not referenced in this Figure for the reasons of legibility), including all the components assembled to the tube, except pusher head 1; to the case during first assembly step E1.

Figure 6B:
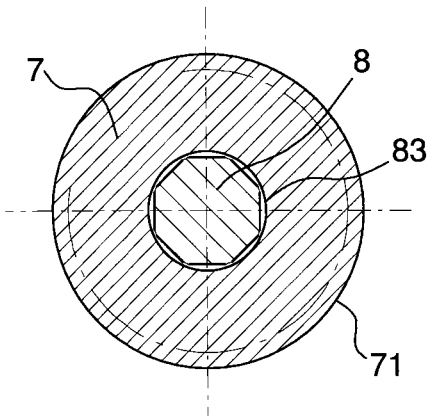
FIG. 6B is a second cross-section of the pusher of FIG. 5, along the axis B-B of FIG. 6A.
Figure 6C:
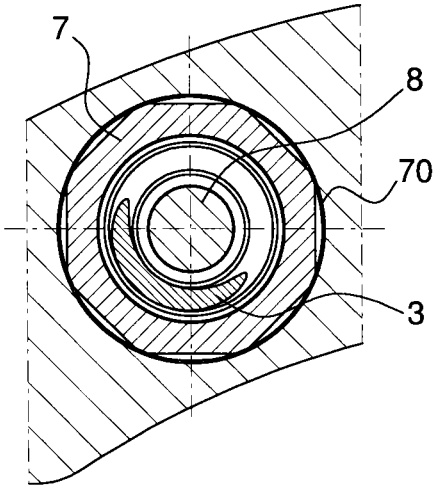
FIG. 6C is a third cross-section of the pusher of FIG. 6A, along the axis C-C of FIG. 6A.

In second step E2 of assembling pusher head 1 to sealed functional module 10, the principle is the same as for the preceding embodiment, namely a step of screwing in pusher head 1 by driving stem 8 in rotation via a tool inserted inside case 100 (not shown in FIGS. 6A-C). However, the screwing-in operation is not performed here on a component secured to stem 8, like insert 2 above, but directly onto the first threaded end of the stem 81. Further, another difference from the preceding embodiment is that the tool inserted inside the middle part is more complex, since it is no longer engaged on a first female drive means 80, like the screw head of FIG. 2, but on a second male drive means 83 located beyond nut 9, like the portion of octagonal section located on the bottom end of stem 8 and shown in detail in FIG. 6B, which is a cross-section along axis B-B shown in FIG. 6A which also shows tube 7 and its screw thread 71. Pressing on pusher head 1 in second step E2 of assembling pusher head 1 to sealed functional module 10, causes the bottom end of stem 8, onto which nut 9 is screwed, to be axially released from bottom orifice 72 of the tube—like the head of the stem at the bottom of FIG. 4—and this portion appears outside tube 7 and can therefore be gripped by a tool to drive stem 8 in rotation. Given that tool has to pass above nut 9 to grip this portion of octagonal section, it could, for example, be a fork. Although it is theoretically also possible to act directly on nut 9 to drive stem 8 in rotation, it is preferable to act on the second male rotational drive means 83 to prevent any risk of inadvertently unscrewing nut 9.

In this second step of assembling pusher head 1 to sealed functional module 10, stem 8 can be screwed into tapped hole 11 of pusher head 1 until it abuts collar 2'.

The advantage of the modular assembly method proposed is that it allows any type of pusher to be assembled more quickly, by first of all assembling a pre-sealed functional module from the outside, then a head of any shape from the inside, without affecting the functional properties, such as for example the length of the pusher travel, and sealing, which can be pre-tested in a dedicated workshop. In the two embodiments described, the screw thread 71 of the tube thus consists of a first assembly means which will be used in first assembly step E1, while respectively the external screw thread 22 of insert 2, and the first threaded end 81 of stem 8 which are engaged in tapped hole 11 of pusher head 1, consist of a second means of assembling functional module 10 to pusher head 1, used in second assembly step E2.

According to an alternative embodiment, instead of being screwed-in and requiring the insertion of a tool inside the case to drive stem 8 in rotation, pusher head 1 could be driven directly from the outside into the sealed functional module pre-assembled to the case. This final method of assembling the head could be adapted for example for the pusher shown in FIG. 2, i.e. using an insert 2, which, in that case, has no thread on its external periphery. This type of insert has a relatively large contact surface with pusher head 1 to allow for the application of sufficient friction forces to retain the pusher head on insert 2. Although this alternative assembly method has the advantage of being even more rapid, since the second assembly step E2 is simplified, it has the drawback, however, of not providing a removable connection between the pusher head and the functional module. Further, this connection has less force, with the risk that pusher head 1 may be pulled out of the middle part after a certain period of time when the elastic deformation stresses of the components are diminished.

It will also be clear to those skilled in the art that the cross-sections of the various drive means have preferably been chosen to be octagonal for reasons of tool standardization, but that any other suitable shape (for example, square, hexagonal, etc.) may also be envisaged.

What is claimed is:

1. A method for modular assembly of a pusher to a watch case, wherein the method comprises:

preliminarily, assembling a sealed functional module, said sealed functional module including a tube, a stem, at least one sealing gasket and a return spring arranged between a first fixed stop member and a second moveable stop member, and then first assembling said sealed functional module to said case, and finally second assembling a pusher head to said sealed functional module, wherein said second assembling includes screwing said pusher head to an element integral with said stem via insertion of a tool inside said watch case to drive said stem in rotation.

2. The method for the modular assembly of a pusher according to claim 1, wherein said tube is screwed from an outside to said case in said first assembling using a rotational drive arranged on said tube.

3. The method for the modular assembly of a pusher according to claim 1, wherein the tool acts on a first female type of rotational drive, or a second male type of drive.

4. The method for the modular assembly of a pusher according to claim 3, wherein said pusher head is pushed to a bottom of a pusher housing in said second assembling.

5. The method for the modular assembly of a pusher according to claim 1, wherein the pusher head is driven onto an element integral with said stem in said second assembling.

6. A modular pusher comprising:

a tube, a stem, at least one sealing gasket, a return spring arranged between a first fixed stop member and a second moveable stop member, and a pusher head that has a non-cylindrical shape, wherein the modular pusher comprises a sealed functional module, said sealed functional module including said tube, said stem, said at least one sealing gasket, said return spring, said first fixed stop member and said second moveable stop member, and also a first structure assembling said sealed functional module to a case, and a second structure assembling said sealed functional module to said pusher head, and the pusher head is inside a housing of the case with a complementary shape to that of the pusher head when the pusher head and the second structure are being assembled together.

7. The modular pusher according to claim 6, wherein the tube includes a rotational drive in the form of a portion of octagonal section to facilitate a screwing thereof into said case.

8. The modular pusher according to claim 7, wherein said pusher stem includes a first threaded end, said pusher head being screwed to said first threaded end or to an external screw thread of an insert screwed to said first threaded end.

9. The modular pusher according to claim 8, wherein said stem includes a second threaded end for securing said stem to said tube and a second male type of drive in the form of a portion of octagonal section for driving said stem in rotation.

10. The modular pusher according to claim 6, wherein said first fixed stop member is formed by a first ring covering said gasket, and said second moveable stop member is formed by an insert screwed to said first end or a collar integral with said stem.

* * * * *